US005439537A

United States Patent [19]

Hinshaw et al.

[11] Patent Number: 5,439,537

[45] Date of Patent: Aug. 8, 1995

[54] THERMITE COMPOSITIONS FOR USE AS GAS GENERANTS

[75] Inventors: Jerald C. Hinshaw, Ogden; Reed J. Blau, Richmond, both of Utah

[73] Assignee: Thiokol Corporation, Ogden, Utah

[21] Appl. No.: 103,768

[22] Filed: Aug. 10, 1993

[51] Int. Cl.[6] ..... C06B 43/00; C06B 47/10; C06B 33/00

[52] U.S. Cl. ..... 149/22; 149/37; 422/165

[58] Field of Search ..... 149/37, 45, 22, 75, 149/108.2, 109.2, 109.4, 35; 280/728

[56] References Cited

U.S. PATENT DOCUMENTS

| | | | |
|---|---|---|---|
| H,464 | 5/1988 | Lee et al. | 102/364 |
| 147,871 | 2/1874 | Shaw . | |
| 2,483,803 | 10/1949 | Bridgman et al. | 73/15.4 |
| 2,981,616 | 4/1961 | Boyer | 52/5 |
| 3,010,815 | 11/1961 | Pierce et al. | 52/5 |
| 3,122,462 | 2/1964 | Kaufman et al. | 149/35 |
| 3,405,068 | 10/1968 | Hiltz | 252/182 |
| 3,447,955 | 11/1969 | Hiltz | 252/4 |
| 3,450,414 | 6/1969 | Kobori | 280/150 |
| 3,674,059 | 7/1972 | Stephenson | 141/4 |
| 3,711,115 | 1/1973 | Lohr | 280/150 AB |
| 3,723,205 | 3/1973 | Scheffee | 149/19 |
| 3,773,351 | 11/1973 | Catanzarite | 280/150 AB |
| 3,773,352 | 11/1973 | Radke | 280/150 AB |
| 3,773,947 | 11/1973 | Boyars et al. | 423/351 |
| 3,775,182 | 8/1973 | Marshall | 252/188.3 |
| 3,779,823 | 12/1973 | Price et al. | 149/19 |
| 3,785,149 | 1/1974 | Timmerman | 60/205 |
| 3,787,074 | 1/1974 | Lewis et al. | 280/150 AB |
| 3,791,302 | 2/1974 | McLeod | 102/70.2 |
| 3,797,238 | 3/1974 | Iwanciow | 60/219 |
| 3,806,461 | 4/1974 | Hendrickson et al. | 252/188.3 R |
| 3,810,655 | 5/1974 | Pracher | 280/150 AB |
| 3,814,694 | 6/1974 | Klager | 252/186 |
| 3,827,715 | 8/1974 | Lynch | 280/150 AB |
| 3,833,029 | 9/1974 | Munn | 141/4 |
| 3,833,432 | 9/1974 | Moy et al. | 149/19.3 |
| 3,837,942 | 9/1974 | Catanzarite | 149/83 |
| 3,862,866 | 1/1975 | Timmerman et al. | 149/21 |
| 3,868,124 | 2/1975 | Johnson | 280/150 AB |
| 3,880,447 | 4/1975 | Thorn et al. | 280/150 AB |
| 3,880,595 | 4/1975 | Timmerman | 23/281 |
| 3,883,373 | 5/1975 | Sidebottom | 149/6 |
| 3,895,098 | 7/1975 | Pietz | 423/351 |
| 3,897,205 | 7/1975 | Hamilton | 149/41 |
| 3,901,747 | 8/1975 | Garner | 149/42 |
| 3,902,934 | 9/1975 | Timmerman | 149/83 |
| 3,910,805 | 10/1975 | Catanzarite | 149/83 |
| 3,912,458 | 10/1975 | Fukuma et al. | 23/281 |
| 3,912,561 | 10/1975 | Doin et al. | 149/35 |
| 3,912,562 | 10/1975 | Garner | 149/41 |
| 3,931,040 | 1/1976 | Breazeale | 252/188.3 R |
| 3,933,543 | 1/1976 | Madden | 149/21 |
| 3,934,984 | 1/1976 | Marlow et al. | 23/281 |
| 3,936,330 | 2/1976 | Dergazarian et al. | 149/35 |
| 3,947,300 | 3/1976 | Passauer et al. | 149/35 |
| 3,950,009 | 4/1976 | Hamilton | 280/150 AB |
| 3,964,255 | 6/1976 | Catanzarite | 60/205 |
| 3,971,729 | 7/1976 | Timmerman | 252/187 R |
| 3,996,079 | 12/1976 | Divalentin | 149/35 |
| 4,021,275 | 5/1977 | Kishi et al. | 149/35 |
| 4,062,708 | 12/1977 | Goetz | 149/35 |
| 4,114,591 | 9/1978 | Nakagawa | 126/263 |
| 4,124,515 | 11/1978 | Gruner et al. | 252/62 |

(List continued on next page.)

*Primary Examiner*—Donald P. Walsh
*Assistant Examiner*—Anthony R. Chi
*Attorney, Agent, or Firm*—Madson & Metcalf; Ronald L. Lyons

[57] ABSTRACT

A sodium-azide-free gas-generating composition includes an oxidizable inorganic fuel, such as a metal, and an oxidizing agent containing oxygen and a metal. The fuel and the oxidizing agent are selected such that water vapor is produced upon reaction between the inorganic fuel and the oxidizing agent. Although a number of inorganic fuels can be employed, a suitable fuel can be a transition metal, another element such as silicon, boron, aluminum, magnesium, an intermetallic compound, hydrides of these metals and mixtures thereof. The oxidizing agent comprises a metal hydroxide, a metal hydrous oxide, a metal oxide hydrate, a metal oxide hydroxide, or mixtures thereof. The fuel and oxidizing agent are selected such that essentially no gases other than water vapor are produced.

44 Claims, No Drawings

U.S. PATENT DOCUMENTS

| | | | |
|---|---|---|---|
| 4,128,996 | 12/1978 | Garner et al. | 60/205 |
| 4,141,734 | 4/1979 | Misra | 423/580 |
| 4,152,891 | 5/1979 | Garner | 60/205 |
| 4,157,648 | 6/1979 | Brennan et al. | 60/205 |
| 4,179,327 | 12/1979 | Seldner | 156/667 |
| 4,200,615 | 4/1980 | Hamilton et al. | 422/166 |
| 4,203,786 | 5/1980 | Garner | 149/19.91 |
| 4,203,787 | 5/1980 | Kirchoff et al. | 149/35 |
| 4,214,438 | 7/1980 | Hamilton et al. | 60/205 |
| 4,238,253 | 12/1980 | Garner | 149/19 |
| 4,244,758 | 1/1981 | Garner et al. | 149/7 |
| 4,246,051 | 1/1981 | Garner et al. | 149/7 |
| 4,298,412 | 11/1981 | Biddle et al. | 149/19.5 |
| 4,306,499 | 12/1981 | Holmes | 102/202.4 |
| 4,339,288 | 7/1982 | Camp | 149/8 |
| 4,369,079 | 1/1983 | Shaw | 149/2 |
| 4,370,181 | 1/1983 | Lundstrom et al. | 149/2 |
| 4,370,930 | 2/1983 | Strasser et al. | 102/530 |
| 4,376,002 | 3/1983 | Utracki | 149/35 |
| 4,390,380 | 6/1983 | Camp | 149/8 |
| 4,407,119 | 10/1983 | Biddle et al. | 60/219 |
| 4,414,902 | 11/1983 | Strasser et al. | 102/531 |
| 4,424,086 | 1/1984 | Christopher | 149/19.3 |
| 4,484,960 | 11/1984 | Rucker | 149/22 |
| 4,533,416 | 8/1985 | Poole | 149/35 |
| 4,547,235 | 10/1985 | Schneiter et al. | 149/35 |
| 4,547,342 | 10/1985 | Adams et al. | 422/166 |
| 4,578,247 | 3/1986 | Bolieau | 422/165 |
| 4,590,860 | 5/1986 | Kromrey | 102/289 |
| 4,604,151 | 8/1986 | Knowlton et al. | 149/35 |
| 4,664,033 | 5/1987 | Burkdoll et al. | 102/275.2 |
| 4,690,063 | 9/1987 | Granier et al. | 102/530 |
| 4,696,705 | 9/1987 | Hamilton | 149/21 |
| 4,698,107 | 10/1987 | Goetz et al. | 149/7 |
| 4,699,400 | 10/1987 | Adams et al. | 280/731 |
| 4,734,141 | 3/1988 | Cartwright et al. | 149/35 |
| 4,758,287 | 7/1988 | Pietz | 149/2 |
| 4,798,142 | 1/1989 | Centerberry et al. | 102/290 |
| 4,806,180 | 2/1989 | Goetz et al. | 149/5 |
| 4,833,996 | 5/1989 | Hayashi et al. | 102/530 |
| 4,834,817 | 5/1989 | Zeuner et al. | 149/35 |
| 4,834,818 | 5/1989 | Kazumi et al. | 149/35 |
| 4,865,667 | 9/1989 | Zeuner et al. | 149/22 |
| 4,890,860 | 1/1990 | Schnieter | 280/741 |
| 4,909,549 | 3/1990 | Poole et al. | 280/738 |
| 4,919,897 | 4/1990 | Bender et al. | 422/165 |
| 4,931,111 | 6/1990 | Poole et al. | 149/35 |
| 4,931,112 | 6/1990 | Wardle et al. | 149/88 |
| 4,948,439 | 8/1990 | Poole et al. | 149/46 |
| 4,950,458 | 8/1990 | Cunningham | 422/164 |
| 4,959,011 | 9/1990 | Nilsson | 431/263 |
| 4,963,203 | 10/1990 | Halcomb et al. | 149/37 |
| 4,981,534 | 1/1991 | Scheffe | 149/19.91 |
| 4,982,664 | 1/1991 | Norton | 102/272 |
| 4,998,751 | 3/1991 | Paxton et al. | 280/741 |
| 5,003,887 | 4/1991 | Unterforsthuber et al. | 102/531 |
| 5,004,586 | 4/1991 | Hayashi et al. | 422/164 |
| 5,005,486 | 4/1991 | Lenzen | 102/531 |
| 5,015,309 | 5/1991 | Wardle et al. | 149/19.1 |
| 5,015,311 | 5/1991 | Ramaswamy | 149/42 |
| 5,019,192 | 5/1991 | Ramaswamy | 149/42 |
| 5,019,220 | 5/1991 | Taylor et al. | 264/3.4 |
| 5,022,674 | 6/1991 | Frantom et al. | 280/741 |
| 5,024,160 | 6/1991 | Canterberry et al. | 102/323 |
| 5,031,932 | 7/1991 | Frantom et al. | 102/323 |
| 5,033,390 | 7/1991 | Minert et al. | 102/530 |
| 5,035,757 | 7/1991 | Poole | 149/46 |
| 5,043,030 | 8/1991 | Ramaswamy | 149/16 |
| 5,046,429 | 9/1991 | Swann et al. | 102/530 |
| 5,052,817 | 11/1991 | Bement et al. | 374/8 |
| 5,060,973 | 10/1991 | Giovanetti | 280/736 |
| 5,062,365 | 11/1991 | Canterberry | 102/322 |
| 5,062,367 | 11/1991 | Hayashi et al. | 102/530 |
| 5,073,273 | 12/1991 | Gupta et al. | 210/760 |
| 5,074,940 | 12/1991 | Ochi et al. | 149/35 |
| 5,089,069 | 2/1992 | Ramaswamy et al. | 149/21 |
| 5,094,475 | 3/1992 | Olsson et al. | 280/741 |
| 5,098,597 | 3/1992 | Rothgery et al. | 252/182.34 |
| 5,100,172 | 3/1992 | Vanvoorhies et al. | 280/738 |
| 5,100,174 | 3/1992 | Jasken et al. | 280/741 |
| 5,104,466 | 4/1992 | Allard et al. | 149/21 |
| 5,212,343 | 5/1993 | Brupacher et al. | 102/323 |

THERMITE COMPOSITIONS FOR USE AS GAS GENERANTS

FIELD OF THE INVENTION

The present invention relates to thermate compositions which are formulated for the purpose of generating a gas, more particularly, the present water vapor generant composition comprises a finely divided oxidizable inorganic fuel, such as boron or a metal, mixed with an appropriate oxidizing agent which, when combusted, generates a large quantity of water vapor.

BACKGROUND OF THE INVENTION

Gas generating chemical compositions are useful in a number of different contexts. One important use for such compositions is in the operation of "air bags." Air bags are gaining in acceptance to the point that many, if not most, new automobiles are equipped with such devices. Indeed, many new automobiles are equipped with multiple air bags to protect the driver and passengers.

In the context of automobile air bags, sufficient gas must be generated to inflate the device within a fraction of a second. Between the time the car is impacted in an accident, and the time the driver would otherwise be thrust against the steering wheel, the air bag must fully inflate. As a consequence, nearly instantaneous gas generation is required.

There are a number of additional important design criteria that must be satisfied. Automobile manufacturers and others have set forth the required criteria which must be met in detailed specifications. Preparing gas generating compositions that meet these important design criteria is an extremely difficult task. These specifications require that the gas generating composition produce gas at a required rate. The specifications also place strict limits on the generation of toxic or harmful gases or solids. Examples of restricted gases include carbon monoxide, carbon dioxide, $NO_x$, $SO_x$, and hydrogen sulfide.

The gas must be generated at a sufficiently and reasonably low temperature so that an occupant of the car is not burned upon impacting an inflated air bag. If the gas produced is overly hot, there is a possibility that the occupant of the motor vehicle may be burned upon impacting a just deployed air bag. Accordingly, it is necessary that the combination of the gas generant and the construction of the air bag isolates automobile occupants from excessive heat. All of this is required while the gas generant maintains an adequate burn rate. In the industry, burn rates in excess of 0.5 inch per second (ips) at 1000 psi, and preferably in the range of from about 1.0 ips to about 1.2 ips at 1000 psi are generally desired.

Another related but important design criteria is that the gas generant composition produces a limited quantity of particulate materials. Particulate materials can interfere with the operation of the supplemental restraint system, present an inhalation hazard, irritate the skin and eyes, or constitute a hazardous solid waste that must be dealt with after the operation of the safety device. In the absence of an acceptable alternative, the production of irritating particulates is one of the undesirable, but tolerated aspects of the currently used sodium azide materials.

In addition to producing limited, if any, quantities of particulates, it is desired that at least the bulk of any such particulates be easily filterable. For instance, it is desirable that the composition produce a filterable, solid slag. If the solid reaction products form a non-fluid material, the solids can be filtered and prevented from escaping into the surrounding environment. This also limits interference with the gas generating apparatus and the spreading of potentially harmful dust in the vicinity of the spent air bag which can cause lung, mucous membrane and eye irritation to vehicle occupants and rescuers.

Both organic and inorganic materials have also been proposed as possible gas generants. Such gas generant compositions include oxidizers and fuels which react at sufficiently high rates to produce large quantities of gas in a fraction of a second.

At present, sodium azide is the most widely used and currently accepted gas generating material. Sodium azide nominally meets industry specifications and guidelines. Nevertheless, sodium azide presents a number of persistent problems. Sodium azide is relatively toxic as a starting material, since its toxicity level as measured by oral rat $LD_{50}$ is in the range of 45 mg/kg. Workers who regularly handle sodium azide have experienced various health problems such as severe headaches, shortness of breath, convulsions, and other symptoms.

In addition, no matter what auxiliary oxidizer is employed, the combustion products from a sodium azide gas generant include caustic reaction products such as sodium oxide, or sodium hydroxide. Molybdenum disulfide or sulfur have been used as oxidizers for sodium azide. However, use of such oxidizers results in toxic products such as hydrogen sulfide gas and corrosive materials such as sodium oxide and sodium sulfide. Rescue workers and automobile occupants have complained about both the hydrogen sulfide gas and the corrosive powder produced by the operation of sodium azide-based gas generants.

Increasing problems are also anticipated in relation to disposal of unused gas-inflated supplemental restraint systems, e.g. automobile air bags, in demolished cars. The sodium azide remaining in such supplemental restraint systems can leach out of the demolished car to become a water pollutant or toxic waste. Indeed, some have expressed concern that sodium azide might form explosive heavy metal azides or hydrazoic acid when contacted with battery acids following disposal.

Sodium azide-based gas generants are most commonly used for air bag inflation, but with the significant disadvantages of such compositions many alternative gas generant compositions have been proposed to replace sodium azide. Most of the proposed sodium azide replacements, however, fail to deal adequately with all of the criteria set forth above.

One group of chemicals that has received attention as a possible replacement for sodium azide includes tetrazoles and triazoles. These materials are generally coupled with conventional oxidizers such as $KNO_3$ and $Sr(NO_3)_2$. Some of the tetrazoles and triazoles that have been specifically mentioned include 5-aminotetrazole, 3-amino-1,2,4-triazole, 1,2,4-triazole, 1H-tetrazole, bitetrazole and several others. However, because of poor ballistic properties and high gas temperatures, none of these materials has yet gained general acceptance as a sodium azide replacement.

It will be appreciated, therefore, that there are a number of important criteria for selecting gas generating compositions for use in automobile supplemental restraint systems. For example, it is important to select starting materials that are not toxic. At the same time, the combustion products must not be toxic or harmful. In this regard, industry standards limit the allowable amounts of various gases produced by the operation of supplemental restraint systems.

It would, therefore, be a significant advance to provide compositions capable of generating large quantities of gas that would overcome the problems identified in the existing art. It would be a further advance to provide a gas generating composition which is based on substantially nontoxic starting materials and which produces substantially nontoxic reaction products. It would be another advance in the art to provide a gas generating composition which produces very limited amounts of toxic or irritating particulate debris and limited undesirable gaseous products. It would also be an advance to provide a gas generating composition which forms a readily filterable solid slag upon reaction.

Such compositions and methods for their use are disclosed and claimed herein.

SUMMARY AND OBJECTS OF THE INVENTION

The present invention relates to a novel gas generating composition which is loosely based on a "thermite"-type composition. The present composition comprises a mixture of finely divided inorganic fuel and an oxidizing agent comprising at least one member from the group consisting of a metal hydroxide, a metal oxide hydrate, a metal oxide hydroxide, a metal hydrous oxide and mixtures thereof, provided that the inorganic fuel and the oxidizing agent are selected such that substantially pure water vapor is produced when the composition is combusted. The combustion reaction involves an oxidation-reduction reaction between the fuel and oxidizing agent. Under the exothermic conditions produced by the reaction, the water is converted to water vapor, which is then available for use in deploying supplemental safety restraint devices such as inflating automobile air bags and the like.

It will be appreciated from the foregoing that the compositions of the present invention can generate large quantities of gas while avoiding some of the significant problems identified in the existing art. The gas generating compositions of the present invention are based on substantially nontoxic starting materials, and produce substantially nontoxic reaction products.

These compositions produce only limited, if any, undesirable gaseous products. In addition, upon reaction, the gas generating compositions of the present invention produce only a limited amount, if any, of toxic or irritating particulate debris while yielding a filterable solid slag.

These compositions combust rapidly and reproducibly to generate substantially pure water vapor as a gaseous reaction product.

DETAILED DESCRIPTION OF THE INVENTION

The compositions of the present invention include an oxidizable inorganic fuel, such as an oxidizable metal or another element, in a fuel-effective amount and an oxidizing agent, in particular, a metal hydroxide compound, in an oxidizer-effective amount. The fuel and the oxidizing agent combination is selected with the proviso that water vapor is the major gaseous product produced upon reaction between the fuel and the oxidizing agent and that essentially no, if any, hazardous gaseous reaction products are produced by that reaction. The fuel and the oxidizer are selected so that the combination of oxidizer and fuel exhibits reasonable thermal compatibility and chemical stability. The fuel or oxidizer, or the combustion products therefrom, which would be highly toxic is not preferred.

In the operation of a supplemental restraint device or related safety device according to the present invention, other gases, if any, are produced in concentrations that are low relative to the desired gaseous combustion product, water vapor.

Thermite is generally defined as a composition consisting of a mixture of finely divided oxidizable inorganic fuel, conventionally aluminum or an oxidizable metal, and a corresponding oxidizing agent. Thermite compositions are conventionally used and designed to generate large quantities of intense heat without generating significant quantities of gas. In that context, the most commonly used thermite compositions are based on finely divided aluminum metal and iron oxide.

One of the distinguishing characteristics of most conventional thermite compositions is that they are designed to produce little or no gaseous reaction products. While having some semblance to conventional thermite compositions, the compositions of the present invention are unique in that gaseous water vapor is the desired major gaseous reaction product and that it is produced in a sufficient amount and volume to be used to inflate an automobile air bag, or for a similar type of function generally performed by gas generating compositions.

The oxidizable inorganic fuel contains, for example, at least one oxidizable species selected from elements from among Groups 2, 4, 5, 6, 7, 8, 12, 13 and 14 as listed in the Periodic Table of the Elements according to the IUPAC format (*CRC Handbook of Chemistry and Physics,* (72nd Ed. 1991)). The oxidizable inorganic fuel can comprise, for instance, at least one transition metal, such as iron, manganese, molybdenum, niobium, tantalum, titanium, tungsten, zinc, or zirconium. The fuel can comprise another element, such as, for instance, aluminum, boron, magnesium, silicon or tin. The fuel can comprise an intermetallic compound or an alloy of at least two elements selected from among Groups 2, 4, 5, 12, 13, and 14 of the Periodic Table. Illustrative of these intermetallic compounds and alloys are, for example, $Al_3Mg_2$, $Al_{38}Si_5$, $Al_2Zr_3$, $B_{12}Zr$, $MgB_4$, $Mg_2Nb$, MgZn, $Nb_3Al$, $Nb_3Sn$, $Ta_3Zr_2$, TiAl, $TiB_2$, $Ti_{18}Nb_5$ and ZrTi. The inorganic fuel can also comprise a hydride of a transition metal or main group element. Exemplary hydrides include, among others, $TiH_2$, $ZrH_2$, and $Cs_2B_{12}H_{12}$. Mixtures of these oxidizable inorganic fuels are also useful herein. A preferred inorganic fuel is elemental boron.

Both the oxidizable inorganic fuel and the oxidizer are incorporated into the composition in the form of a finely divided powder. Particle sizes range from about $0.001\mu$ to about $400\mu$, although the particle sizes preferably range from about $0.1\mu$ to about $50\mu$. The composition is insertable into a gas generating device, such as a supplemental safety restraint system, in the form of pellets or tablets. Alternatively, the composition is insertable in such devices in the form of a multi-perforated, high surface area grain or other solid form which allows rapid and reproducible generation of gas upon ignition.

A metal-containing oxidizing agent is paired with the fuel. In the present context, a metal-containing oxidizing agent has the following characteristics:

(a) It is a compound or solid state phase containing at least one type of metal, oxygen and hydrogen.

(b) One or more of the metals contained therein can act as an oxidizing agent for the inorganic fuel found in the gas generant formulation.

Given the foregoing, the class of suitable inorganic oxidizers possessing the desired traits includes metal hydroxides, metal oxide hydrates, metal oxide hydroxides, metal hydrous oxides and mixtures thereof wherein the metal species therein can be at least one species selected from elements from among Groups 5, 6, 7, 8, 9, 10, 11, 12, 14 and 15 as listed in the Periodic Table of the Elements according to the IUPAC format (*CRC Handbook of Chemistry and Physics,* (72nd Ed. 1991) ) . Examples of metal hydroxides include, among others, $Fe(OH)_3$, $Co(OH)_3$, $Co(OH)_2$, $Ni(OH)_2$, $Cu(OH)_2$, and $Zn(OH)_2$. Examples of metal oxide hydrates and metal hydrous oxides include, among others, $Fe_2O_3.xH_2O$, $SnO_2.xH_2O$, and $MoO_3.H_2O$. Examples of metal oxide hydroxides include, among others, $CoO(OH)_2$, $FeO(OH)_2$, $MnO(OH)_2$ and $MnO(OH)_3$. In certain instances it will also be desirable to use mixtures of such oxidizing agents in order to enhance ballistic properties or maximize filterability of the slag formed from combustion of the composition. A preferred oxidizing agent is $Cu(OH)_2$.

In addition, small amounts, such as up to about 10 wt. %, of supplemental oxidizing agents, such as metal oxides, peroxides, nitrates, nitrites, chlorates and perchlorates, can, if desired, be combined with a metal hydroxide-containing oxidizer. With the use of nitrates, and nitrites as supplemental oxidizing agents, small amounts of nitrogen will be produced in addition to water vapor.

The gas generant compositions of the present invention comprise a fuel-effective amount of fuel and an oxidizer-effective amount of at least one oxidizing agent. The present composition, in general, contains about 2 wt % to about 50 wt % fuel and from about 50 wt % to about 98 wt % oxidizing agent, and preferably from about 5 wt % to about 30 wt % fuel and from about 70 wt % to about 95 wt % oxidizing agent. These weight percentages are such that at least one oxidizing agent is present in an amount from about 0.5 to about 3 times the stoichiometric amount necessary to completely oxidize the fuel present. More preferably, the oxidizing agent is present from about 0.9 to about 2 times the stoichiometric amount of oxidizer necessary to completely oxidize the fuel present.

Small quantities of other additives may also be included within the compositions if desired. Such additives are well known in the explosive, propellant, and gas generant arts. Such materials are conventionally added in order to modify the characteristics of the gas generating composition. Such materials include ballistic or burn rate modifiers, ignition aids, coolants, release agents or dry lubricants, binders for granulation or pellet crush strength, slag enhancers, etc. An additive often serves multiple functions. Ignition aids/burn rate modifiers include metal oxides, nitrates and other compounds such as, for instance, $Fe_2O_3$, $K_2B_{12}H_{12}.H_2O$, $BiO(NO_3)$, $Co_2O_3$, $CoFe_2O_4$, $CuMoO_4$, $Bi_2MoO_6$, $MnO_2$, $Mg(NO_3)_2$, $Fe(NO_3)_2$, $Co(NO_3)_2$, and $NH_4NO_3$. Coolants include magnesium hydroxide, boric acid, aluminum hydroxide, and silicotungstic acid. Coolants such as aluminum hydroxide and silicotungstic acid can also function as slag enhancers. Small amounts of polymeric binders, such as polyethylene glycol or polypropylene carbonate can, if desired, be added for mechanical properties reasons or to provide enhanced crush strength. Examples of dry lubricants include $MoS_2$, graphite, graphitic-boron nitride, calcium stearate and powdered polyethylene glycol (Avg. MW 8000).

The solid combustion products of most of the additives mentioned above will enhance the filterability of the slag produced upon combustion of a gas generant formulation. For example, a preferred embodiment of the invention comprises a combination of $Cu(OH)_2$ as the oxidizer and elemental boron as the fuel. The slag therefrom is biphasic where the phases consist of $Cu/Cu_2O$ and $B_2O_3/HBO_2$, respectively. Over a significant range of $Cu(OH)_2$:boron mole ratios, such as about 3:1 to about 1:1, flame temperatures are such that at least one phase is relatively fluid in nature. Cobalt nitrate (a burn rate enhancer, ignition aid and granulation binder), $Co_2O_3$ (a burn rate modifier), and $Co(OH)_2$ (a coolant) form a mixture of Co/CoO upon combustion. Experimental evidence suggests that Co/CoO is miscible with $Cu/Cu_2O$ and increases the viscosity of the $Cu/Cu_2O$ slag. Thus, any of the above cobalt-containing compounds can be added to a formulation to enhance the viscosity of the copper slag as well as enhance formulation performance in other areas. Similarly, magnesium nitrate (a burn rate enhancer, ignition aid and granulation binder) and $Mg(OH)_2$ (a coolant) form MgO upon combustion. Magnesium oxide is known to form stable ternary phases with $B_2O_3$. Thus, the formation of these ternary $Mg_xB_yO_z$ phases deters scavenging of water by $B_2O_3$ as well as increases the viscosity of the $B_2O_3/HBO_2$ slag phase. For example, overall slag viscosity can be varied while keeping the flame temperature essentially constant by selectively varying the amount of added magnesium nitrate as a burn rate enhancer and $Co(OH)_2$ as a coolant.

Reaction of typical compositions falling within the scope of the present invention can be depicted as follows:

$$AM^1+A^1M^2(OH)_x \rightarrow XM^1O_y+YM^2O_z+ZH_2O$$

where $M^1$ is the fuel, $M^2(OH)_x$ is the metal, oxygen and hydrogen-containing oxidizing agent, and x, y, and z adjust the atomic ratios in the respective reactants and products and the values A, $A^1$, X, Y and Z are adjusted as needed to balance the reaction depending on stoichiometry and oxidation state of the metals.

Examples of reactions involving compositions within the scope of the present invention are set forth in Table I.

TABLE I

| Reaction | Theoretical Gas Yield | Flame Temp. (°K) |
|---|---|---|
| $Ti + 2Cu(OH)_2 \rightarrow TiO_2 + 2Cu + 2H_2O$ | 0.82 | 2241 |
| $Mo + 2Cu(OH)_2 \rightarrow MoO_2 + 2Cu + 2H_2O$ | 0.83 | 1153 |
| $2Fe + 3Cu(OH)_2 \rightarrow Fe_2O_3 + 3Cu + 3H_2O$ | 0.83 | 920 |
| $2Cr + 3Cu(OH)_2 \rightarrow Cr_2O_3 + 3Cu + 3H_2O$ | 0.83 | 1707 |
| $2B + 3Cu(OH)_2 \rightarrow B_2O_3 + 3Cu + 3H_2O$ | 0.83 | 1962 |
| $TiH_2 + 3Cu(OH)_2 \rightarrow TiO_2 + 3Cu + 4H_2O$ | 1.1 | 1501 |

TABLE I-continued

| Reaction | Theoretical Gas Yield | Flame Temp. (°K) |
|---|---|---|
| $W + 3Cu(OH)_2 \rightarrow WO_3 + 3Cu + 3H_2O$ | 0.86 | 1076 |
| $2B + 3Co(OH)_2 \rightarrow B_2O_3 + 3Cu + 3H_2O$ | 0.88 | 1276 |
| $2B + 3Ni(OH)_2 \rightarrow B_2O_3 + 3Ni + 3H_2O$ | 0.93 | 1405 |
| $4B + 3Co(OH)_2 + 3Cu(OH)_2 \rightarrow 2B_2O_3 + 3Co + 3Cu + 6H_2O$ | 0.89 | 1626 |

Theoretical gas yields (gas volume and quantity) for a composition according to the present invention are comparable to those achieved by a conventional sodium azide-based gas generant compositions. Theoretical gas yield is a normalized relation to a unit volume of azide-based gas generant. The theoretical gas yield for a typical sodium azide-based gas generant (68 wt. % $NAN_3$; 30 wt % of $MoS_2$; 2 wt % of S) is about 0.85 g gas/cc $NaN_3$ generant.

The theoretical flame temperatures of the reaction between the fuel and the oxidizing agent are in the range of from about 500° K. to about 3500° K., with the more preferred range being from about 1200° K. to about 1800° K. This is a manageable range for application in the field of automobile air bags and can be adjusted to form non-liquid (e.g., solid) easily filterable slag.

With the reaction characteristics, the compositions and methods of the present invention can produce a sufficient volume and quantity of gas to inflate a supplemental safety restraint device, such as an automobile air bag, at a manageable temperature. The reaction of the compositions within the scope of the invention produce significant quantities of water vapor in a very short period of time. At the same time, the reaction substantially avoids the production of unwanted gases and particulate materials, although water vapor may be produced in combination with nontoxic and minor amounts of other gases such as oxygen, carbon dioxide or nitrogen when the composition includes a co-oxidizer, polymeric binder or processing aids. Unlike most known gas generant compositions, the compositions of the present invention do not produce significant, if any, amounts of $NO_x$, $SO_x$, CO, $CO_2$, or $H_2S$, although an igniter formulation, ballistic modifier, release agent or other additive, if present, could produce small amounts of these gases.

One of the important characteristics of gas generants, particularly for use in automobile supplemental restraint systems, is that they have adequate crush strength. If the material does not have adequate crush strength, the material tends to pulverize resulting in too high of a surface area and dangerous ballistic characteristics. Compositions within the scope of the present invention are capable of providing adequate crush strengths. Crush strength in the range of 50 lbs load at failure to 200 lbs load at failure are achievable with a composition according to the present invention.

The present gas generant compositions can be formulated to produce an integral solid slag to limit substantially the particulate material produced. This minimizes the production of solid particulate debris outside the combustion chamber. Thus, it is possible to substantially avoid the production of a caustic powder, such as sodium oxide/hydroxide or sodium sulfide, commonly produced by conventional sodium azide formulations.

The compositions of the present invention are easily ignited with conventional igniters. Igniters using materials such as boron/potassium nitrate are usable with the compositions of the present invention. Thus, it is possible to substitute the compositions of the present invention in gas generant applications.

The gas generating compositions of the present invention are readily adapted for use with conventional hybrid air bag inflator technology. Hybrid inflator technology is based on heating a stored inert gas (argon or helium) to a desired temperature by burning a small amount of propellant. Hybrid inflators do not require cooling filters used with pyrotechnic inflators to cool combustion gases, because hybrid inflators are able to provide a lower temperature gas. The gas discharge temperature can be selectively changed by adjusting the ratio of inert gas weight to propellant weight. The higher the gas weight to propellant weight ratio, the cooler the gas discharge temperature.

A hybrid gas generating system comprises a pressure tank having a rupturable opening, a predetermined amount of inert gas disposed within that pressure tank; a gas generating device for producing hot combustion gases and having means for rupturing the rupturable opening; and means for igniting the gas generating composition. The tank has a rupturable opening which can be broken by a piston when the gas generating device is ignited. The gas generating device is configured and positioned relative to the pressure tank so that hot combustion gases are mixed with and heat the inert gas. Suitable inert gases include, among others, argon, and helium and mixtures thereof. The mixed and heated gases exit the pressure tank through the opening and ultimately exit the hybrid inflator and deploy an inflatable bag or balloon, such as an automobile airbag. The gas generating device contains a gas generating composition according to the present invention which comprises an oxidizable inorganic fuel and an oxidizing agent comprising at least one metal hydroxide, metal oxide hydrate, metal oxide hydroxide, metal hydrous oxide or mixtures thereof with the oxidizable inorganic fuel and oxidizing agent being selected so that water vapor is produced upon reaction between the inorganic fuel and the oxidizing agent.

The high heat capacity of water vapor is an added advantage for its use as a heating gas in a hybrid gas generating system. Thus, less water vapor, and consequently, less generant is needed to heat a given quantity of inert gas to a given temperature. A preferred embodiment of the invention yields hot (1800° K.) metallic copper as a combustion product. The high conductivity of the copper allows a rapid transfer of heat to the cooler inert gas causing a further improvement in the efficiency of the hybrid gas generating system.

Hybrid gas generating devices for supplemental safety restraint application are described in Frantom, Hybrid Airbag Inflator Technology, *Airbag Int'l Symposium on Sophisticated Car Occupant Safety Systems,* (Weinbrenner-Saal, Germany, Nov. 2–3, 1992).

An automobile air bag system can comprise a collapsed, inflatable air bag, a gas generating device connected to the air bag for inflating the air bag, and means for igniting the gas generating composition. The gas generating device contains a gas generating composition comprising an oxidizable inorganic fuel and an oxidizing agent comprising at least one metal hydroxide, metal oxide hydrate, metal oxide hydroxide, metal hydrous oxide or mixtures thereof with the oxidizable inorganic fuel and oxidizing agent being selected so that water vapor is produced upon reaction between the inorganic fuel and the oxidizing agent.

A distinct advantage of an automobile air bag system generating predominantly water vapor to inflate the bag is a significant lowering of $NO_x$ and CO levels that are in equilibrium with hot (>1500° K.) nitrogen and carbon dioxide, respectively. Since the concentrations of nitrogen and carbon dioxide in the present generated gas are significantly lower, there will therefore be a greater tendency towards lower $NO_x$ and CO levels, respectively. The most favorable embodiment, in this respect, is the complete absence of carbon dioxide and/or nitrogen as generant gases.

EXAMPLES

The present invention is further described in the following non-limiting examples. Unless otherwise stated, the compositions are expressed in wt. %.

Example 1

A mixture of 80.29 wt % $Cu(OH)_2$ (Alpha technical grade 61 wt. percent Cu) and 19.71 wt % Ti (Alpha 1μ–3μ) was slurried in acetone. The acetone was allowed to evaporate, leaving a powder. This powder ignited with a hot wire and burned completely leaving a slag.

Example 2

A mixture of 61.42% $Cu(OH)_2$ and 38.58% tungsten, −325 mesh, was prepared in an acetone slurry as in Example 1. The dry powder ignited with a hot wire and burned completely.

Example 3

A mixture of 72.92% $Cu(OH)_2$, 6.46% boron, and 20.62% silicotungstic acid ($SiO_2$. $12WO_3.26H_2O$), (Baker analyzed) was prepared by dissolving the silicotungstic acid in methanol and slurrying the $Cu(OH)_2$ and boron in this solution. A portion of the methanol was evaporated to obtain a moist gas generant composition. The moist composition was granulated through a 24-mesh screen and then dried completely. Three 4-gram quantities of the dried powder were pressed into 0.5-inch diameter pellets at 9000-lb gauge pressure in a Carver Model M press. The pellets were equilibrated individually at 1000 psi for 10 min and ignited yielding a burn rate of 0.447±0.014 ips. The slag consisted of a solid mass of boron-tungsten oxide intermingled with copper metal. Five 0.78 g, 0.375-inch diameter, and 0.19-inch maximum height pellets were found to have a pellet crush strength of 83±11 pounds load at failure.

Example 4

A mixture of 93.12% $Cu(OH)_2$ (Alpha, 61 percent Cu) and 6.88 percent boron (Trona, lot #1) was prepared in an acetone slurry as in Example 1. Six 4-gram quantities of the dried powder were pressed into 0.5-inch diameter pellets at 9000-lb gauge pressure. The pellets showed a burn rate of 0.528 ips at 1000 psi and a burn rate exponent of 0.375 over a pressure range of 300–2100 psi. After combustion, a slag containing copper metal remained. Three pellets formed at 10200-gauge pressure weighing 0.78 g with a diameter of 0.375 inch and a maximum height of 0.19 inch showed a pellet crush strength of 190±23 pounds load at failure.

Example 5

A mixture of 3.44% boron, 7.28% $TiH_2$ (Johnson-Matthey 1μ–3μ) and 89.28% $Cu(OH)_2$ was prepared in an acetone slurry. Four grams of the material were pressed into a 0.5-inch diameter pellet as above. The pellet showed a burn rate of 0.21 ips at 1000 psi.

Example 6

A mixture of 3.44% boron, 12.08% $ZrH_2$ (Johnson-Matthey 5μ) and 84.48% $Cu(OH)_2$ prepared as above showed a pellet burn rate of 0.31 ips at 1000 psi.

Example 7

A mixture of 6.02% boron, 92.87% $Cu(OH)_2$, and 1.11% $K_2B_{12}H_{12}$. $H_2O$ (Callery Chemical Company) burn rate catalyst prepared as above showed a pellet burn rate of 0.45 ips at 1000 psi.

Example 8

A mixture of 87.34% $Cu(OH)_2$, 7.68% boron (SB 90–92%) and 4.96% $Co_2O_3$ (Sargent Welch) mixed as a thin paste in water and dried in vacuo showed a pellet burn rate of 0.717 ips at 1000 psi.

Example 9

A mixture of 86.92% $Cu(OH)_2$, 8.12% boron (SB 90–92%) and 4.96% $BiO(NO_3)$ (Aldrich) mixed as a thin paste in water and dried in vacuo showed a pellet burn rate of 0.717 ips at 1000 psi.

Example 10

A mixture of 87.55% $Cu(OH)_2$, 7.49% boron (SB 90–92%) and 4.96% $Bi_2MoO_6$ (Johnson Matthey) mixed as a thin paste in water and dried in vacuo showed a pellet burn rate of 0.718 ips at 1000 psi.

Example 11

A mixture of 83.33% $Cu(OH)_2$, 7.15% boron (SB 90–92%) and 9.52% $Co(OH)_2$ (Johnson Matthey) mixed as a thin paste in water and dried in vacuo showed a pellet burn rate of 0.658 ips at 1000 psi.

Example 12

A mixture of 84.33% $Cu(OH)_2$, 8.02% boron (SB 90–92%) and 7.66% [Co $(NO_3).6H_2O$] (Mallinckrodt) mixed as a thin paste in water and dried in vacuo showed a pellet burn rate of 0.714 ips at 1000 psi.

Example 13

A mixture of 86.81% $Cu(OH)_2$, 6.90% boron (SB 90–92%) and 6.06% $Mg(OH)_2$ (Aldrich) mixed as a thin paste in water and dried in vacuo showed a pellet burn rate of 0.481 ips at 1000 psi.

Example 14

A mixture of 83.54% $Cu(OH)_2$, 8.19% boron (SB 90–92%) and 8.26% [$Mg(NO_3)_2.x6H_2O$] (Baker) mixed as a thin paste in water and dried in vacuo showed a pellet burn rate of 0.726 ips at 1000 psi.

Example 15

A mixture of 87.34% $Cu(OH)_2$, 7.70% boron (SB 90–92%) and 4.96% $\alpha$-$Fe_2O_3$ (Pyrocat Superfine, Mach I Inc.) mixed as a thin paste in water and dried in vacuo showed a pellet burn rate of 0.749 ips at 1000 psi.

Example 16

A 575 g mixture of 88.02% $Cu(OH)_2$, (Johnson-Matthey, 62.5% Cu, 12$\mu$ average particle size), 6.51% boron (Trona, lot #1), and 5.48% boric acid (Baker analyzed) was prepared by adding 31.5 g of the boric acid dissolved in 450 mL of methanol to 506.1 g of copper(II) hydroxide in the bowl of a Hobart C-100 mixer. After remote blending of these ingredients with the mixer, 37.4 g of boron were added. After 1.5 hr. of further mixing, sufficient methanol had evaporated to allow granulation. The generant was granulated through a 24-mesh screen, allowed to dry, and sieved. The $-30/+60$ mesh portion was mixed with 0.75% of its total weight in $MoS_2$. Six 4 g, 0.5-inch pellets were formed at 13000 psi gauge pressure and were used to determine ballistic performance over the range of 300–2100 psi. The composition had a burn rate of 0.563 ips at 1000 psi and a burn rate exponent of 0.349.

Two additional pellets were prepared and ignited separately in a 500 ml Parr bomb under 5 atm of argon. After each pellet was burned, the gas generated in the bomb was bubbled through a methanol solution, the water condensed in the bomb was absorbed by methanol and transferred into a 250 ml volumetric flask. The total water content found in the gaseous and condensed phases was determined via the Karl Fischer method. The maximum theoretical yield of moisture that could be produced by combustion of the pellets was calculated as 18.6 wt. % After corrections for moisture absorbed in blank samples, the yield of water generated by the pellets was found to be 19.1±0.4%.

Example 17

The formulation of Example 4 was pressed into approximately 0.37-inch diameter×0.18-inch length pellets at 5100 psi gauge pressure. Twenty-two of the pellets (14.88 g) were placed in a combustion chamber connected to a 706 cubic inch tank. The pellets were ignited with a 0.25 g charge of boron/potassium nitrate igniter and the chamber pressure and tank pressure recorded. A maximum combustion chamber pressure of 60 psi and maximum tank pressure of 32 psi were measured.

Example 18

The formulation of Example 6 was pressed remotely using a Stokes Model 555 rotary press into 0.127-inch diameter×0.109±0.001-inch height pellets with a density of 2.56±0.07 g/cc. One thousand none hundred and twenty-four of these pellets (109.03 g) were placed in a combustion chamber connected to a 744 cubic inch tank. The pellets were ignited with 1.0 g of boron/potassium nitrate igniter. A maximum combustion chamber pressure of 750 psi a and maximum tank pressure of 145 psi were measured. The slag consisted of copper metal and a white boron oxide powder.

Example 19

Two thousand two hundred and sixty-four, 129.5 g, of the pellets of Example 18 were placed in a combustion chamber connected to a fabric bag of the type used in current driver-side automobile inflatable restraint systems. The pellets were ignited with a charge of 2.5 g of boron/potassium nitrate igniter. The bag totally inflated within 0.06 second with a maximum pressure of 4 psi. The combustion chamber showed a maximum pressure of 1250 psi with a maximum temperature of 1550° K.

Example 20

Theoretical calculations were conducted on the formulation of Example 4 to evaluate its use in a hybrid gas generator. If this formulation is allowed to undergo combustion in the presence of 3.81 times its weight in argon gas, the flame temperature decreases from 1962° K. to 990° K. assuming 100% efficient heat transfer. The output gases consist of 91.7% by volume argon and 8.3% by volume water vapor.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What we claim is:

1. A solid gas-generating composition comprising an oxidizable inorganic fuel and an oxidizing agent, wherein said oxidizing agent comprises at least one member selected from the group consisting of a metal hydroxide, a metal hydrous oxide, a metal oxide hydrate, a metal oxide hydroxide and mixtures thereof, and water vapor is the major gaseous reaction product generated by said gas-generating composition wherein said oxidizing agent is present in an amount from about 0.5 to about 3 times the stoichiometric amount of oxidizing agent necessary to completely oxidize the fuel present.

2. A solid gas-generating composition according to claim 1, comprising from about 2% to about 50% fuel and from about 50% to about 98% oxidizing agent.

3. A solid gas-generating composition according to claim 1, comprising from about 5% to about 30% fuel and from about 70% to about 95% oxidizing agent.

4. A solid gas-generating composition according to claim 1, wherein said oxidizing agent is present in an amount from about 0.9 to about 2 times the stoichiometric amount of oxidizing agent necessary to completely oxidize the fuel present.

5. A solid gas-generating composition according to claim 1, wherein said oxidizable inorganic fuel is a metal.

6. A solid gas-generating composition according to claim 1, wherein said oxidizable inorganic fuel is a transition metal.

7. A solid gas-generating composition according to claim 1, wherein said oxidizable inorganic fuel is selected from the group consisting of boron, silicon and tin.

8. A solid gas-generating composition according to claim 1, wherein said oxidizable inorganic fuel is selected from the group consisting of aluminum and magnesium.

9. A solid gas-generating composition according to claim 1, wherein said oxidizable inorganic fuel is an intermetallic compound or an alloy of at least two elements selected from among Groups 2, 4, 5, 12, 13, and 14 of the Periodic Table.

10. A solid gas-generating composition according to claim 1, wherein said oxidizable inorganic fuel is a transition metal hydride.

11. A solid gas-generating composition according to claim 1, wherein no $NO_x$ or $SO_x$ is produced by the reaction of said oxidizable inorganic fuel and said oxidizing agent.

12. A solid gas-generating composition according to claim 1, wherein no CO or $CO_2$ is produced by the reaction of said oxidizable inorganic fuel and said oxidizing agent.

13. A gas-generating composition according to claim 10, wherein said oxidizable inorganic fuel contains at least one member selected from one group consisting of Al, B, Fe, Mg, Mn, Mo, Nb, Ta, Si, Sn, Ti, W, Zn, and Zr.

14. An automobile air bag system comprising:

a collapsed, inflatable air bag;

a gas-generating device connected to said air bag for inflating said air bag, said gas-generating device containing a gas-generating composition comprising an oxidizable inorganic fuel and at least one oxidizing agent selected from the group consisting of metal hydroxide, metal hydrous oxide, metal oxide hydrate, metal oxide hydroxide and mixtures thereof, said oxidizable inorganic fuel and said oxidizing agent being selected such that water vapor is a major gaseous reaction product generated by said gas-generating composition wherein said oxidizing agent is present in an amount from about 0.5 to about 3 times the stoichiometric amount of oxidizing agent necessary to completely oxidize the fuel present; and means for igniting said gas-generating composition.

15. An automobile air bag system according to claim 14, wherein said gas-generating composition comprises from about 2% to about 50% oxidizable inorganic fuel and from about 50% to about 98% oxidizing agent.

16. An automobile air bag system according to claim 14, wherein said gas-generating composition comprises from about 70% to about 95% oxidizing agent.

17. An automobile air bag system according to claim 14, wherein the oxidizing agent of said gas-generating composition is present in an amount from about 0.9 to about 2 times the stoichiometric amount of oxidizer necessary to completely oxidize the fuel present.

18. An automobile air bag system according to claim 14, wherein said oxidizable inorganic fuel is a metal.

19. An automobile air bag system according to claim 18, wherein said oxidizable inorganic fuel is a transition metal.

20. An automobile air bag system according to claim 14, wherein said oxidizable inorganic fuel is selected from the group consisting of boron, silicon and tin.

21. An automobile air bag system according to claim 14, wherein said oxidizable inorganic fuel is selected from the group consisting of aluminum and magnesium.

22. An automobile air bag system according to claim 14, wherein said oxidizable inorganic fuel is an intermetallic compound or alloy of two or more elements selected from among Groups 2, 4, 5, 12, 13, 14 and 15 of the Periodic Table.

23. An automobile air bag system according to claim 14, wherein said oxidizable inorganic fuel is a transition metal hydride.

24. An automobile air bag system having a hybrid gas-generating system comprising:

a collapsed, inflatable air bag, a gas-generating device connected to said air bag for inflating said air bag;

a pressure tank having a rupturable opening, said pressure tank containing an inert gas;

said gas-generating device for producing hot combustion gases and capable of rupturing said rupturable opening, said gas-generating device being configured in relation to said pressure tank such that hot combustion gases are mixed with and heat said inert gas, said gas-generating device containing a gas-generating composition comprising an oxidizable inorganic fuel and at least one oxidizing agent selected from the group consisting of metal hydroxide, metal hydrous oxide, metal oxide hydrate, metal oxide hydroxide and mixtures thereof, said oxidizable inorganic fuel and oxidizing agent being selected such that water vapor is a major gaseous product generated by said gas-generating composition wherein said oxidizing agent is present in an amount from about 0.5 to about 3 times the stoichiometric amount of oxidizing agent necessary to completely oxidize the fuel present; and means for igniting said gas-generating composition.

25. A hybrid gas-generating system according to claim 24, wherein said inert gas is argon or helium.

26. A hybrid gas-generating system according to claim 24, wherein said gas-generating composition comprises from about 2% to about 50% fuel and from about 50% to about 98% oxidizing agent.

27. A hybrid gas-generating system according to claim 24, wherein said gas-generating composition comprises from about 70% to about 95% oxidizing agent.

28. A hybrid gas-generating system according to claim 24, wherein the oxidizing agent of said gas-generating composition is present in an amount from about 0.9 to about 2 times the stoichiometric amount of oxidizer necessary to completely oxidize the fuel present.

29. A hybrid gas-generating system according to claim 24, wherein said oxidizable inorganic fuel is a metal.

30. A hybrid gas-generating system according to claim 24, wherein said oxidizable inorganic fuel is a transition metal.

31. A hybrid gas-generating system according to claim 24, wherein said oxidizable inorganic fuel is selected from the group consisting of boron, silicon and tin.

32. A hybrid gas-generating system according to claim 24, wherein said oxidizable inorganic fuel is selected from the group consisting of aluminum and magnesium.

33. A hybrid gas-generating system according to claim 24, wherein said oxidizable inorganic fuel is an intermetallic compound or alloy of two or more elements selected from Groups 2, 4, 5, 12, 13, and 14 of the Periodic Table.

34. A hybrid gas-generating system according to claim 24, wherein said oxidizable inorganic fuel is a transition metal hydride.

35. A solid gas-generating composition according to claim 1 wherein the oxidizable inorganic fuel and the oxidizer are in the form of a finely divided powder.

36. A solid gas-generating composition according to claim 35 wherein the particle size range of the powder is from about $0.001\mu$ to about $400\mu$.

37. A solid gas-generating composition according to claim 1 wherein the metal-containing oxidizing agent is a compound or solid state phase material containing at least one type of metal, oxygen and hydrogen.

38. A solid gas-generating composition according to claim 1 wherein a metal contained in the metal-containing oxidizing agent acts as an oxidizing agent for the inorganic fuel.

39. A solid gas-generating composition according to claim 1 wherein the oxidizing agent comprises a metal selected from the group consisting of Groups 5, 6, 7, 8, 9, 10, 11, 12, 14, 15, or mixtures thereof of the Periodic Table.

40. A solid gas-generating composition according to claim 1 wherein the oxidizing agent is $Cu(OH)_2$.

41. A solid gas-generating composition according to claim 1 wherein the oxidizable inorganic fuel is elemental boron.

42. A solid gas-generating composition comprising a mixture containing elemental boron and $Cu(OH)_2$, wherein water vapor is the major gaseous reaction product generated by the reaction between said elemental boron and said $Cu(OH)_2$.

43. A vehicle containing a supplemental restraint system having an air bag system comprising:

a collapsed, inflatable air bag, a gas-generating device connected to said air bag for inflating said air bag, said gas-generating device containing a gas-generating composition comprising an oxidizable inorganic fuel and at least one oxidizing agent selected from the group consisting of metal hydroxide, metal hydrous oxide, metal oxide hydrate, metal oxide hydroxide and mixtures thereof, said oxidizable inorganic fuel and said oxidizing agent being selected such that water vapor is a major gaseous reaction product generated by a said gas-generating composition wherein said oxidizing agent is present in an amount from about 0.5 to about 3 times the stoichiometric amount of oxidizing agent necessary to completely oxidize the fuel present; and means for igniting said gas-generating composition.

44. A vehicle containing a supplemental restraint system comprising an air bag system containing:

a hybrid gas generating system containing:

a collapsed, inflatable air bag, a gas generating device connected to said air bag, a pressure tank having a rupturable opening, said pressure tank containing an inert gas, said gas generating device capable of producing hot combustion gases and for rupturing said rupturable opening, said gas-generating device being configured in relation to said pressure tank such that hot combustion gases are mixed with and heat said inert gas, said gas-generating composition comprising an oxidizable inorganic fuel and at least one oxidizing agent selected from the group consisting of metal hydroxide, metal hydrous oxide, metal oxide hydrate, metal oxide hydroxide and mixtures thereof, said oxidizable inorganic fuel and oxidizing agent being selected such that water vapor is a major gaseous reaction product generated by said gas-generating composition wherein said oxidizing agent is present in an amount from about 0.5 to about 3 times the stoichiometric amount of oxidizing agent necessary to completely oxidize the fuel present; and means for igniting said gas-generating composition.

* * * * *